US008465290B1

(12) United States Patent
Rodriguez

(10) Patent No.: US 8,465,290 B1
(45) Date of Patent: Jun. 18, 2013

(54) ATHLETIC TRAINING DEVICE

(76) Inventor: Mark G. Rodriguez, Manassas, VA (US)

( * ) Notice: Subject to any disclaimer, the term of this patent is extended or adjusted under 35 U.S.C. 154(b) by 238 days.

(21) Appl. No.: 13/029,354

(22) Filed: Feb. 17, 2011

(51) Int. Cl.
*A63B 69/00* (2006.01)

(52) U.S. Cl.
USPC ..... 434/247

(58) Field of Classification Search
USPC ..... 434/247, 251, 255, 258; 473/440, 473/454, 455, 479; 482/14, 15
See application file for complete search history.

(56) References Cited

U.S. PATENT DOCUMENTS

| | | | | |
|---|---|---|---|---|
| 3,115,340 | A | 12/1963 | Stasiuk | |
| 3,255,115 | A | 6/1966 | Peterson | |
| 3,433,480 | A | 3/1969 | Coleman et al. | |
| 4,059,268 | A | 11/1977 | Forrest | |
| 4,176,471 | A | 12/1979 | Roe | |
| D260,910 | S | 9/1981 | Moseley | |
| 4,446,666 | A * | 5/1984 | Gilman | 52/648.1 |
| 4,556,219 | A * | 12/1985 | Tillery | 473/197 |
| 4,702,478 | A * | 10/1987 | Kruse | 273/127 B |
| 5,351,948 | A * | 10/1994 | Thomas | 473/417 |
| 5,405,304 | A * | 4/1995 | Petersheim et al. | 482/35 |
| 5,944,318 | A * | 8/1999 | Payton | 273/402 |
| 6,966,852 | B2 * | 11/2005 | Yoon | 473/421 |
| 8,257,088 | B1 * | 9/2012 | Askins | 434/247 |
| 2009/0286656 | A1 * | 11/2009 | Okamoto | 482/78 |

* cited by examiner

*Primary Examiner* — Kurt Fernstrom

(57) ABSTRACT

An athletic training kit featuring a plurality of diamond shape frames. The frames can interconnect to form various obstacle courses. Each frame has a first side, a second side, a third side, and a fourth side. The kit also features various means of connecting the sides of the frames together. Elbow joints, cord cap components, or offset hinges may connect the sides of the frames together. The cord cap components feature a connecting cord. The connecting cords of different frames can be connected in various ways to set up a multi-frame obstacle course. The kit may feature extension connectors, cord connectors, or pin hinges.

8 Claims, 6 Drawing Sheets

ATHLETIC TRAINING DEVICE

FIELD OF THE INVENTION

The present invention is directed to a device for helping athletes improve speed, agility, and other qualities, more particularly to a device that a user can arrange on a court or field in a particular pattern.

BACKGROUND OF THE INVENTION

Many different obstacle courses exist for athletic training. The present invention features a novel athletic training device for helping athletes improve speed, agility, and other qualities. The device can be arranged on a court or on a field in a pattern of the user's interest and needs.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features an athletic training kit (device). The kit may comprise a plurality of diamond shape frames 110, a plurality of elbow joints 130, and a plurality of cord cap components. Each frame 110 has a first side 111, a second side 112, a third side 113, and a fourth side 114. The frame 110 has a generally hollow center. The elbow joints are adapted to attach to (i) a first end of the first side 111 of the frame 110 and a first end of the third side 113 of the frame 110 to connect the first side 111 and third side 113 together; (ii) a first end of the second side 112 of the frame and a first end of the fourth side 114 of the frame 110 to connect the second side 112 and fourth side 114 together; (iii) a second end of the first side 111 of the frame 110 and a second end of the fourth side 114 of the frame 110 to connect the first side 111 and fourth side 114 together; or (iv) a second end of the second side 112 of the frame 110 and a second end of the third side 113 of the frame 110 to connect the second side 112 and third side 113 together. The cord cap components each have a first cap 150 and a second cap 150 connected by a cord 120. The first cap 150 and the second cap 150 are adapted to attach to (i) the first end of the first side 111 of the frame 110 and the first end of the third side 113 of the frame 110, respectively, to connect the first side 111 and third side 113 together; (ii) the first-end of the second side 112 of the frame and the first end of the fourth side 114 of the frame 110, respectively, to connect the second side 112 and fourth side 114 together; (iii) the second end of the first side 111 of the frame 110 and the second end of the fourth side 114 of the frame 110, respectively, to connect the first side 111 and fourth side 114 together; or (iv) the second end of the second side 112 of the frame 110 and the second end of the third side 113 of the frame 110, respectively, to connect the second side 112 and third side 113 together.

In some embodiments, the kit further comprises an extension connector 710, the extension connector 710 is an elongated panel having a first end 711 and a second end 712, wherein the first end 711 of the extension connector 710 is adapted to engage a cord 120 of cord cap component of a first frame 110 via a first attachment means and the second end 712 of the extension connector 710 is adapted to engage a cord 120 of cord cap component of a second frame 110 via a second attachment means. In some embodiments, the first attachment means and second attachment means is a snap mechanism, a button mechanism, a latch mechanism, a buckle mechanism, a magnet mechanism, a clamp mechanism, or a combination thereof.

In some embodiments, a first button 720*a* is disposed on a top surface of the extension connector 710 at the first end 711 and a second button 720*b* is disposed on the top surface of the extension connector 710 at the second end 712, and a plurality of slits 722 is disposed in the extension connector 710 running from the first end 711 to the second end 712, wherein the buttons 720 can engage the slits 722. In some embodiments, the kit further comprises a cord connector 410, the cord connector 410 comprises a cord connector base 415 with a first wing 411 and second wing 412 extending outwardly from the cord connector base 415, wherein the first wing 111 and second wing 112 are separated so as to allow a cord 120 to slide in between, a cord connector slot 416 is disposed in the cord connector base 415, the cord connector slot 416 opens to an outer end of the cord connector base 415 allowing a cord 120 to snugly slide into the cord connector slot 416.

In some embodiments, the kit further comprises an offset hinge 610 adapted to engage (i) the first end of the first side 111 of the frame 110 and the first end of the third side 113 of the frame 110 to connect the first side 111 and third side 113 together; (ii) the first end of the second side 112 of the frame and the first end of the fourth side 114 of the frame 110 to connect the second side 112 and fourth side 114 together; (iii) the second end of the first side 111 of the frame 110 and the second end of the fourth side 114 of the frame 110 to connect the first side 111 and fourth side 114 together; or (iv) the second end of the second side 112 of the frame 110 and the second end of the third side 113 of the frame 110 to connect the second side 112 and third side 113 together, the offset hinge 610 allows the sides that are connected together to pivot towards each other or away from each other. In some embodiments, the kit further comprises a pin hinge 620 attached to the offset hinge 610, the pin hinge 620 can connect to a second offset hinge 610.

In some embodiments, a first stand 160*a* is pivotally attached to the first side 111 of the frame 110, a second stand 160*b* is pivotally attached to the first side 111 of the frame 110, a third stand 160*c* is pivotally attached to the first side 111 of the frame 110, and a fourth stand 160*d* is pivotally attached to the first side 111 of the frame 110, the stands 160 can pivot between multiple positions including a storage position wherein the stands 160 are flush with the respective side 111, 112, 113, 114 of the frame 110 and an extended position wherein the stands 160 are perpendicular to the respective side 111, 112, 113, 114 of the frame 110.

DESCRIPTION OF PREFERRED EMBODIMENTS

Figure 1:
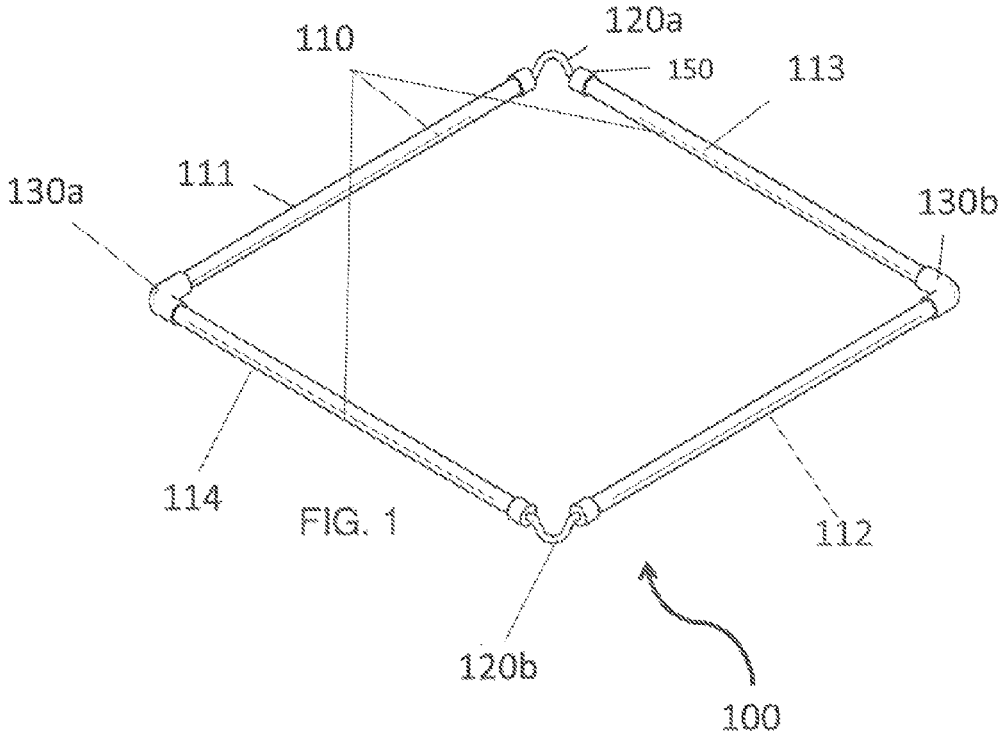
FIG. 1 is a perspective view of the athletic training device of the present invention.
Figure 2:
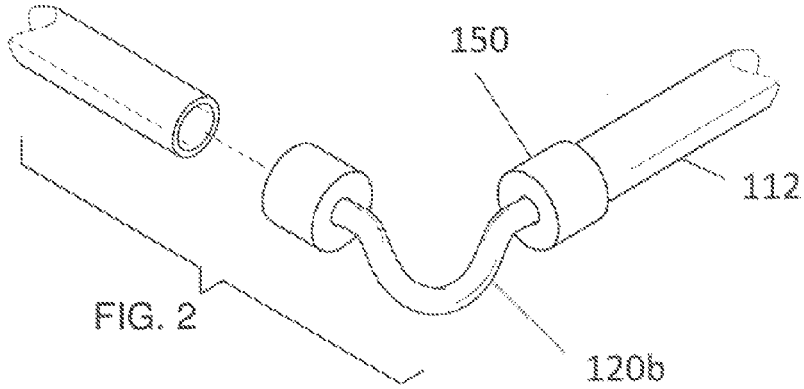
FIG. 2 is an exploded view of the athletic training device of the present invention.

Referring now to FIGS. 1-7, the present invention features an athletic training device 100 for helping an athlete improve his/her speed, agility, coordination, strength, and/or stamina.

The athletic training device 100 of the present invention features a series of diamond-shaped frames 110. The frames 110 have a first side 111, a second side 112, a third side 113, and a fourth side 114. The frames 110 have a generally hollow center. In some embodiments, the frame 110 is generally flat. In some embodiments, the frame 110 is raised or comprises grooves.

The frames 110 have a first corner at the intersection of the first side 111 and third side 113, a second corner at the intersection of the first side 111 and the fourth side 114, a third corner at the intersection of the second side 112 and the third side 113, and a fourth corner at the intersection of the second side 112 and the fourth side 114. Disposed in the first corner connecting the first side 111 and third side 113 is a first cord 120*a*. Disposed in the second corner connecting the first side 111 and the fourth side 114 is a first elbow joint 130*a*. Disposed in the third corner connecting the second side 112 and the third side 113 is a second elbow joint 130*b*. Disposed in the fourth corner connecting the second side 112 and the fourth side 114 is a second cord 120*b*. In some embodiments, a cap 150 is disposed on the first end of the first side 111 and on the first end of the third side 113, wherein the first cord 120*a* is connected to the two caps 150. In some embodiments, a cap 150 is disposed on first end of the second side 112 and on the first end of the fourth side 114, wherein the second cord 120*b* is connected to the two caps 150.

The caps 150 (with the cords 120) and the elbow joints 130 are removable and interchangeable. Thus, an elbow joint 130 may connect the first end of the first side 111 and the first end of the third side 113 or the first end of the second side 112 and the first end of the fourth side 114. A cord 120 may connect the second end of the first side 111 with the second end of the fourth side 114 and the second end of the second side 112 with the second end of the third side 113.

In some embodiments, a first stand 160*a* (e.g., 3 inch) is pivotally attached to the first side 111 of the frame 110. In some embodiments, a second stand 160*b* (e.g., 3 inch) is pivotally attached to the first side 111 of the frame 110. In some embodiments, a third stand 160*c* (e.g., 5 inch) is pivotally attached to the first side 111 of the frame 110. In some embodiments, a fourth stand 160*d* (e.g., 5 inch) is pivotally attached to the first side 111 of the frame 110. The stands 160 pivot between multiple positions including but not limited to a storage position (e.g., flush with the respective side 111, 112, 113, 114) and an extended position (e.g., perpendicular to the respective side 111, 112, 113, 114). The stands 160 may be half pipe in shape (e.g., half cylinders), thereby wrapping around the respective side when in the storage position. When the stands 160 are in the extended position, they raise the frame 110 above a ground surface a certain distance.

Figure 3:
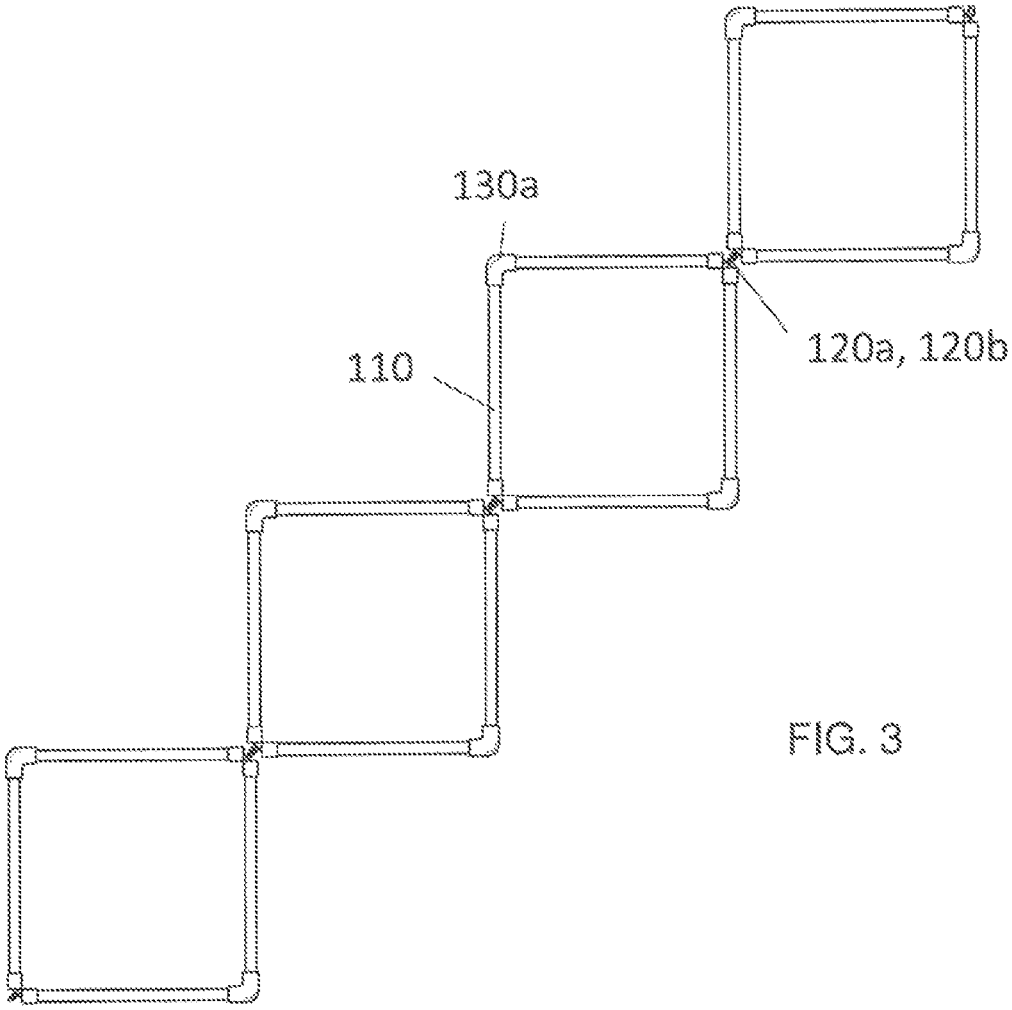
FIG. 3 is a top view of the athletic training device of the present invention wherein four frames are connected together.
Figure 4:
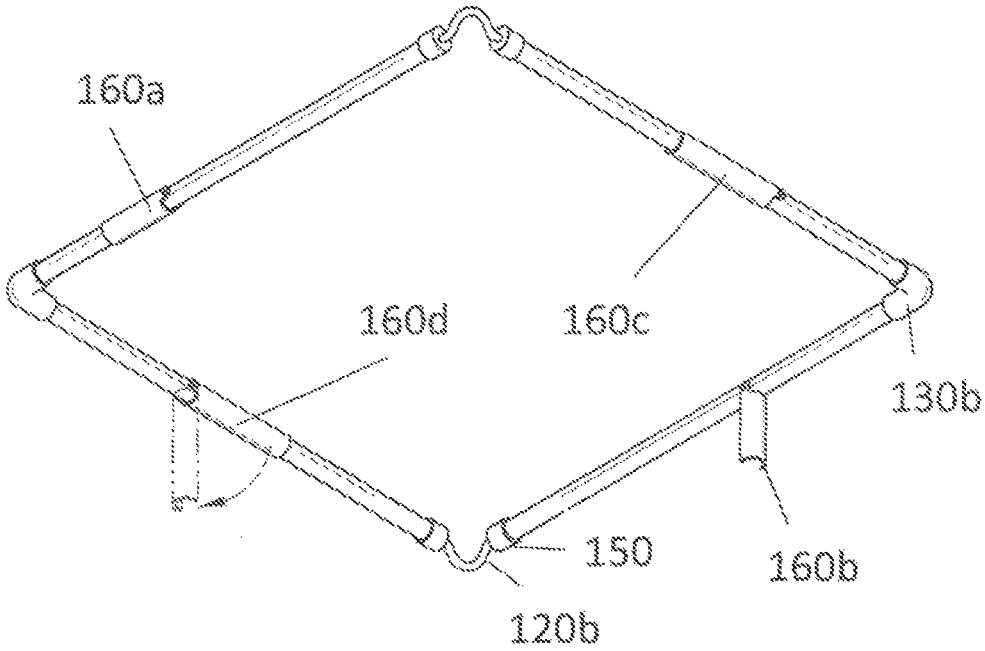
FIG. 4 is a bottom perspective view of the athletic training device of the present invention.

As shown in FIG. 3, a plurality of frames 110 can be connected together by wrapping together the cords 120. For example, the second cord 120*b* of a first frame can be wrapped or engaged with the first cord 120*a* of a second adjacent frame.

Figure 7:
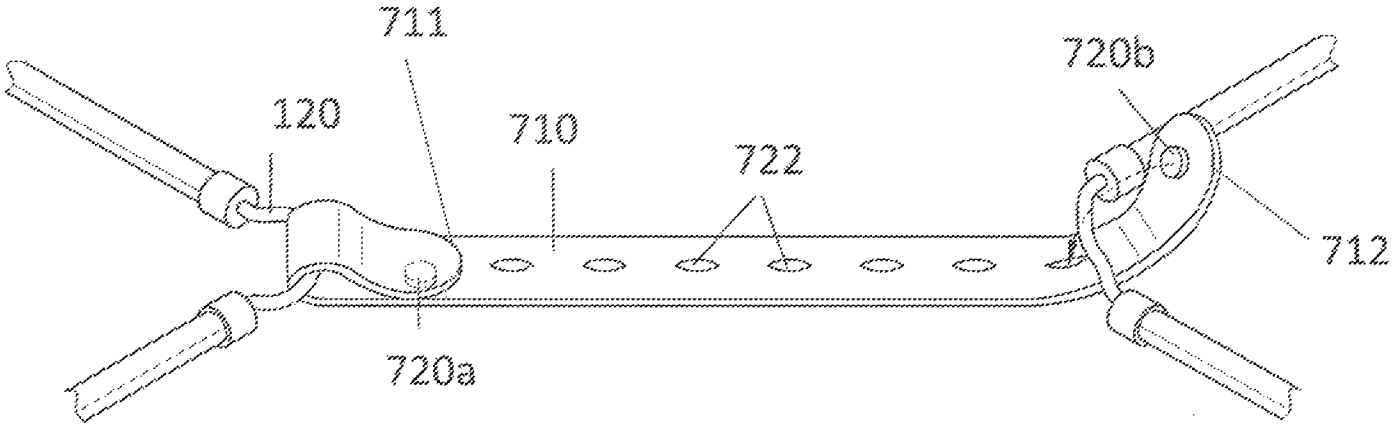
FIG. 7 is an exploded view of an alternative embodiment of athletic training device of the present invention.

In some embodiments, the frames 110 are connected together via an extension connector 710 (e.g., see FIG. 7). The extension connector 710 is an elongated panel having a first end 711 and a second end 712. The first end 711 engages a cord 120 of a first frame 110 via a first attachment means and the second end 712 of the extension connector 710 engages a cord 120 of a second frame 110 via a second attachment means. In some embodiments, the first attachment means and second attachment means is a snap mechanism, a button mechanism, a latch mechanism, a buckle mechanism, a magnet mechanism, a clamp mechanism, the like, or a combination thereof. For example, as shown in FIG. 7, the attachment means are button mechanisms. A first button 720*a* is disposed on the top surface of the extension connector 710 at the first end 711 and a second button 720*b* is disposed on the top surface of the extension connector 710 at the second end 712. A plurality of slits 722 is disposed in the extension connector 710 running from the first end 711 to the second end 712 (or a portion in between). The buttons 720 can engage the slits 722. For example, the first end 711 of the extension connector 710 can be wrapped around a cord 120 and the first button 720*a* can engage a slit 722 in the extension connector 710 to secure the extension connector 710 around the cord 120. The second end 712 of the extension connector 710 can be wrapped around a cord 120 and the second button 720 can engage a slit 722 in the extension connector 710 to secure the extension connector 710 around the cord 120.

Figure 5:
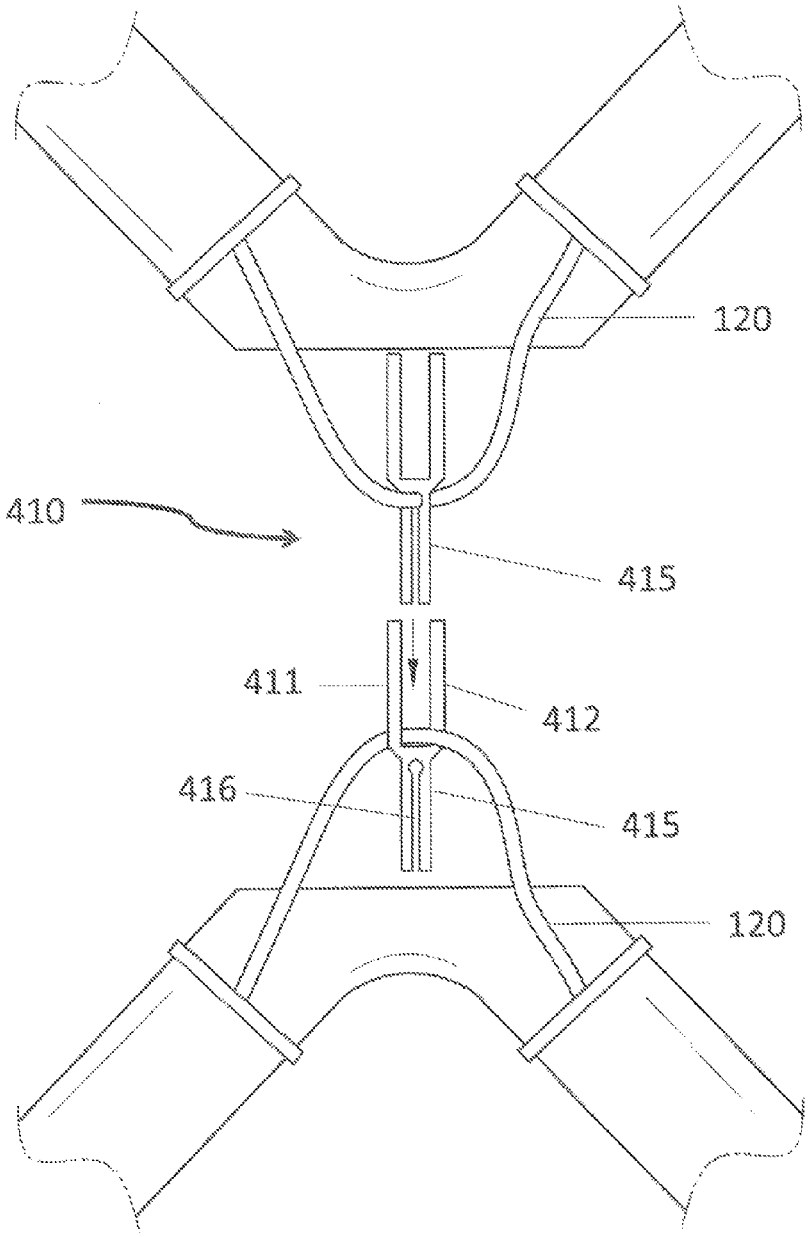
FIG. 5 is an exploded view of the athletic training device of the present invention.
Figure 6:
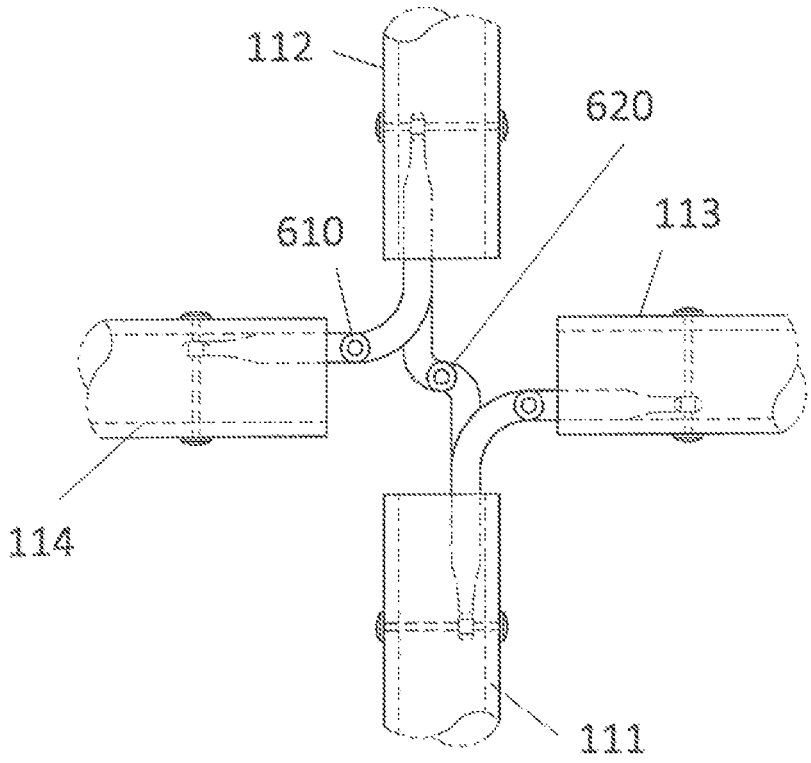
FIG. 6 is an exploded view of an alternative embodiment of athletic training device of the present invention.

In some embodiments, the frames 110 are connected together via cord connectors 410. As shown in FIG. 5, the cord connectors may be Y-shaped components with a cord connector base 415 with a first wing 411 and 412 second wing extending outwardly from the cord connector base 415. A cord 120 can fit between the first wing 411 and the second wing 412. A cord connector slot 416 is disposed in the cord connector base 415. The cord connector slot 416 opens to the outer end of the cord connector base 415 allowing a cord 120 to snugly slide into the slot 416.

In some embodiments, the caps 150 and cords 120 or elbow joints 130 are replaced with hinges. For example, an offset hinge 610 may connect the first side 111 and third side 113, the first side 111 and the fourth side 114, the second side 112 and the third side 113, and/or the second side 112 and the fourth side 114. The offset hinges 610 allow the two sides that are connected together to pivot towards each other or away from each other (to a certain angle, for example about 90 degrees, about 60 degrees, about 30 degrees, about 110 degrees, etc.). A pin hinge 620 connects two offset hinges 610 together.

To use the athletic training device of the present invention, a user can arrange the frames 110 on a court, a field, or other surface in a desired manner. The frames 110 can then be secured at desired distances using the cords 120, the hinges, the extension connector 710, the cord connectors 410, etc. In some embodiments, the frames 110 are positioned in line with one another; in some embodiments, the frames 110 are positioned at different angles with respect to each other. In some embodiments, the frames 110 are arranged to form (as viewed from above) a linear line, a diagonal line, a square, a diamond, a square with a hollow center, a diamond with a hollow center, a plus sign, an X, or an irregular shape, for example. An athlete may then run through the frames 110 (e.g., like a ladder) or step within the frames 110 in a particular sequence. An athlete can engage in a wide range of drills, for example leap frog, slalom, two-legged drills, skipping diamonds, the like, or a combination thereof. The present invention is not limited to the aforementioned drills.

The athletic training device 100 of the present invention may be constructed from a variety of materials. For example, in some embodiments, the frame 100 is constructed from a material comprising nylon (e.g., webbing), a plastic, a rubber, a metal, the like, or a combination thereof.

In some embodiments, all or portions of the frame 110 can be colored (e.g., red, blue, green, yellow, orange, violet, black, brown, light, dark, etc). In some embodiments, the frames 110 are colored for easy assembly or for assembly of various configurations.

The athletic training device 100 of the present invention may be constructed in a variety of sizes. For example, in some embodiments, the athletic training device 100 may be constructed in a small size for children and a large size for adults.

In some embodiments, the frame 110 is about 16 inches in length as measured from the first side 111 to the second side 112. In some embodiments, the frame 110 is between about 16 to 20 inches in length as measured from the first side 111 to the second side 112. In some embodiments, the frame 110 is more than about 20 inches in length as measured from the first side 111 to the second side 112.

In some embodiments, the frame 110 is about 16 inches in width as measured from the third side 113 to the fourth side 114. In some embodiments, the frame 110 is between about 16 to 20 inches in width as measured from the third side 113 to the fourth side 114. In some embodiments, the frame 110 is more than about 20 inches in width.

In some embodiments, the frame 110 is between about 1 to 2 inches in thickness (e.g., in diameter). In some embodiments, the frame 110 is between about 2 to 4 inches in thickness (e.g., in diameter). In some embodiments, the frame 110 is more than about 4 inches in thickness (e.g., in diameter).

The following the disclosures of the following U.S. Patents are incorporated in their entirety by reference herein: U.S. Pat. No. 3,115,340; U.S. Pat. No. 3,255,115; U.S. Pat. No. 3,433,480; U.S. Pat. No. 4,059,268; U.S. Pat. No. 4,176,471.

EXAMPLE 1

The following example describes various versions of the device 100 of the present invention. The present invention is not limited to the examples described herein.

The device 100 may come in five different designs that cover all ages and ability. (1) "Diamond Aerobic"—1" wide× 18" per side. A flat single stiff rubber frame for studio aerobic fitness that can be added on to by using additional frames. No connector necessary. (2) "Diamond Ladders & Squares"—All corners will have connector that slides in to corner slot sideways, and 1" wide×16" per side. This version is a gym class/game version for elementary use and play at home. This version can come apart for creating different game designs. (3) "Diamond Ladder Advanced"—Fully molded with two sliced cut out openings (no full openings). A smaller ½" round×17" per side model for youth athletes. (4) "Diamond Ladder Pro"—Fully molded with two sliced cut out openings (no full openings). A larger ½" Round×22" per side for (varsity elite) athletes. (5) "Diamond Ladder Extreme"—A ½" round×22" per side transforming/all in one system. This version replaces multiple independent training aids within and of itself. It folds over and props up to form mini hurdles at different heights. It can be extended for extremely challenging speed development by using extenders. It can attach at all 4 points, 2 points by plugs and 2 points by hinge or rope connector. It can be used in tandem for more reps during limited time.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An athletic training kit comprising:

(a) a plurality of diamond shape frames (110), each frame (110) has a first side (111), a second side (112), a third side (113), and a fourth side (114), each frame (110) has a generally hollow center;

(b) a plurality of elbow joints, the elbow joints are adapted to attach to (i) a first end of the first side (111) of each frame (110) and a first end of the third side (113) of each frame (110) to connect the first side (111) and third side (113) together; (ii) a first end of the second side (112) of each frame and a first end of the fourth side (114) of each frame (110) to connect the second side (112) and fourth side (114) together; (iii) a second end of the first side (111) of each frame (110) and a second end of the fourth side (114) of each frame (110) to connect the first side (111) and fourth side (114) together; or (iv) a second end of the second side (112) of each frame (110) and a second end of the third side (113) of each frame (110) to connect the second side (112) and third side (113) together; and (c) a plurality of cord cap components, the cord cap components each have a first cap (150) and a second cap (150) connected by a cord (120), the first cap (150) and the second cap (150) are adapted to attach to (i) the first end of the first side (111) of each frame (110) and the first end of the third side (113) of each frame (110), respectively, to connect the first side (111) and third side (113) together; (ii) the first end of the second side (112) of each frame and the first end of the fourth side (114) of each frame (110), respectively, to connect the second side (112) and fourth side (114) together; (iii) the second end of the first side (111) of each frame (110) and the second end of the fourth side (114) of each frame (110), respectively, to connect the first side (111) and fourth side (114) together; or (iv) the second end of the second side (112) of each frame (110) and the second end of the third side (113) of each frame (110), respectively, to connect the second side (112) and third side (113) together.

2. The kit of claim 1 further comprising an extension connector (710), the extension connector (710) is an elongated panel having a first end (711) and a second end (712), wherein the first end (711) of the extension connector (710) is adapted to engage a cord (120) of cord cap component of a first frame (110) via a first attachment means and the second end (712) of the extension connector (710) is adapted to engage a cord (120) of cord cap component of a second frame (110) via a second attachment means.

3. The kit of claim 2, wherein the first attachment means and second attachment means is a snap mechanism, a button mechanism, a latch mechanism, a buckle mechanism, a magnet mechanism, a clamp mechanism, or a combination thereof.

4. The kit of claim 2, wherein a first button (720*a*) is disposed on a top surface of the extension connector (710) at the first end (711) and a second button (720*b*) is disposed on the top surface of the extension connector (710) at the second end (712), and a plurality of slits (722) is disposed in the extension connector (710) running from the first end (711) to the second end (712), wherein the buttons (720) can engage the slits (722).

5. The kit of claim 1 further comprising a cord connector (410), the cord connector (410) comprises a cord connector base (415) with a first wing (411) and second wing (412) extending outwardly from the cord connector base (415), wherein the first wing (111) and second wing (112) are separated so as to allow a cord (120) to slide in between, a cord connector slot (416) is disposed in the cord connector base (415), the cord connector slot (416) opens to an outer end of the cord connector base (415) allowing a cord (120) to snugly slide into the cord connector slot (416).

6. The kit of claim 1 further comprising an offset hinge (610) adapted to engage (i) the first end of the first side (111) of each frame (110) and the first end of the third side (113) of each frame (110) to connect the first side (111) and third side (113) together; (ii) the first end of the second side (112) of each frame and the first end of the fourth side (114) of each frame (110) to connect the second side (112) and fourth side (114) together; (iii) the second end of the first side (111) of each frame (110) and the second end of the fourth side (114) of each frame (110) to connect the first side (111) and fourth side (114) together; or (iv) the second end of the second side (112) of each frame (110) and the second end of the third side (113) of each frame (110) to connect the second side (112) and third side (113) together, the offset hinge (610) allows the sides that are connected together to pivot towards each other or away from each other.

7. The kit of claim 6 further comprising a pin hinge (620) attached to the offset hinge (610), the pin hinge (620) can connect to a second offset hinge (610).

8. The kit of claim 1, wherein a first stand (160*a*) is pivotally attached to the first side (111) of each frame (110), a second stand (160*b*) is pivotally attached to the first side (111) of each frame (110), a third stand (160*c*) is pivotally attached to the first side (111) of each frame (110), and a fourth stand (160*d*) is pivotally attached to the first side (111) of each frame (110), the stands (160) can pivot between multiple positions including a storage position wherein the stands (160) are flush with the respective side (111), (112), (113), (114) of each frame (110) and an extended position wherein the stands (160) are perpendicular to the respective side (111), (112), (113), (114) of each frame (110).

* * * * *